US005091610A

United States Patent [19]

Strauss

[11] Patent Number: 5,091,610

[45] Date of Patent: Feb. 25, 1992

[54] HIGH IMPEDANCE ELECTRICAL CABLE

[75] Inventor: Richard F. Strauss, Morrisville, Pa.

[73] Assignee: Thomas & Betts Corporation, Bridgewater, N.J.

[21] Appl. No.: 585,860

[22] Filed: Sep. 19, 1990

[51] Int. Cl.[5] ..... H01B 7/08

[52] U.S. Cl. ..... 174/117 F; 156/51; 174/113 A; 174/117 R; 174/117 FF; 174/119 R; 174/133 R

[58] Field of Search ..... 174/113 R, 113 A, 117 R, 174/117 F, 117 FF, 119 R, 133 R; 156/47, 50, 51; 29/825

[56] References Cited

U.S. PATENT DOCUMENTS

| | | | |
|---|---|---|---|
| Re. 31,477 | 12/1983 | Marshall | 174/115 |
| 1,853,677 | 4/1932 | Fischer | 174/32 |
| 1,996,186 | 4/1935 | Affel | 174/32 |
| 3,248,576 | 4/1966 | Russell | 307/147 |
| 3,459,879 | 8/1969 | Gerpheide | 174/117 FF |
| 3,511,728 | 5/1970 | Freedman et al. | 156/52 |
| 4,209,215 | 6/1980 | Verma | 439/497 |
| 4,313,029 | 1/1982 | Bunish | 174/115 |
| 4,468,089 | 8/1984 | Brorein | 350/96.23 |
| 4,513,170 | 4/1985 | Apodaca | 174/36 |
| 4,698,457 | 10/1987 | Bordbar | 174/36 |

FOREIGN PATENT DOCUMENTS

| | | | |
|---|---|---|---|
| 1169096 | 12/1958 | France | 174/70 C |
| 37284 | 3/1979 | Japan | 156/50 |
| 113880 | 9/1979 | Japan | 156/50 |
| 32937 | 7/1985 | Japan | 156/47 |
| 84517 | 3/1989 | Japan | 156/50 |

*Primary Examiner*—Morris H. Nimmo
*Attorney, Agent, or Firm*—Robert M. Rodrick; Salvatore J. Abbruzzese

[57] ABSTRACT

An electrical cable assembly includes a plurality of electrical conductors supported within an insulative casing. The conductors are arranged in side-by-side transversely spaced position and the casing surrounds and electrically isolates each of the conductors. The casing includes a major planar surface permitting mass termination to a connector. One of the conductors includes a flat surface portion which faces an adjacent one of the side-by-side conductors and also includes a curved surface portion which faces the major planar surface.

10 Claims, 2 Drawing Sheets

HIGH IMPEDANCE ELECTRICAL CABLE

FIELD OF THE INVENTION

This invention relates generally to multiconductor electrical cable and more particularly relates to an improved high impedance cable having conductors being spaced at a given pitch.

BACKGROUND OF THE INVENTION

Flat multiconductor ribbon cable is used extensively in the electronics industry, especially in the computer field. Cable of this type typically includes a plurality of electrical conductors arranged in side-by-side spaced orientation. These conductors are surrounded by an insulative casing which electrically isolates each of the conductors.

Several factors affect the quality and reliability of these cables. The size of each conductor, measured by the cross-sectional area, dictates the amount of signal current that each conductor can carry. The amount of signal current carried is directly proportional to the size of the conductor.

In addition, the impedance value of the cable is related, in part, to the spacing between adjacent conductors. In cables having similar dielectric constants, the greater the space between adjacent conductors (i.e. the more insulating mass therebetween) the greater the impedance value of the cable.

It is desirable to construct a cable which is capable of carrying high signal currents while also having a high impedance value. Thus, cable having large conductors and ample spacing between adjacent conductors would be ideal. However, in the modern computer environment, a cable assembly of this construction is not practical. In fact, the current state of the computer industry is to require smaller cable, i.e. cable with conductors spaced at a smaller pitch, while maintaining the high signal carrying capabilities of the cable as well as the high impedance value. However, when spacing conductors at a smaller pitch, the insulating mass between facing surfaces of adjacent conductors is reduced. This results in lowering the impedance value of the cable. Side-by-side round conductors, typically used in cables of this type, when spaced at a small pitch, would result in the facing curved surfaces of adjacent conductors being in close proximity. This would cause the impedance value to be lowered beyond tolerability.

The art has seen the use of rectangular conductors in flat multiconductor cable assemblies which permit the conductors to be placed on a smaller pitch while maintaining more insulating mass between facing surfaces of adjacent conductors. However, rectangular conductors are difficult to form and are more expensive than conventional round conductors. Further, in most computer applications, mass cable termination to insulation displacing contacts of electrical connectors is desired. Rectangular conductors are inherently difficult to mass terminate in this manner.

It is therefore desirable to provide a flat multiconductor electrical cable which permits spacing of electrical conductors at a reduced pitch while maintaining a high degree of signal transmission and a high impedance value.

SUMMARY OF THE INVENTION

It is an object of the present invention to provide an improved multiconductor electrical cable.

It is a further object of the invention to provide an electrical cable having conductors spaced at a small pitch while providing high signal transmission and high impedance value.

In the efficient attainment of these and other objects, the present invention provides an electrical cable assembly including a plurality of elongate electrical conductors and an insulative casing surrounding each of the conductors. The conductors are arranged in side-by-side transversely spaced orientation. The casing includes a major planar surface. One of the conductors includes a flat surface portion which faces an adjacent one of the plural conductors. The one conductor further includes a curved surface portion which faces the major planar surface to provide mass termination capabilities.

As particularly shown by way of the preferred embodiment herein, the present invention provides a flat multiconductor electrical cable including a substantially flat insulative casing having upper and lower planar surfaces. Plural elongate electrical conductors are arranged in transversely spaced disposition between the upper and lower planar surfaces. Each of the conductors includes a flat surface portion positioned substantially perpendicularly to the upper and lower planar surfaces and a curved surface portion facing at least one of the upper or lower planar surfaces.

DETAILED DESCRIPTION OF THE PREFERRED EMBODIMENTS

Figure 1:
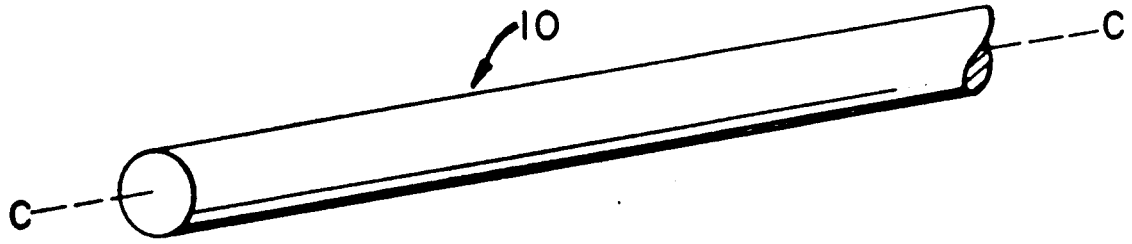
FIG. 1 (PRIOR ART)
FIG. 1 shows an extent of a conventional round conductor of the type used in accordance with the present invention.
Figure 2:
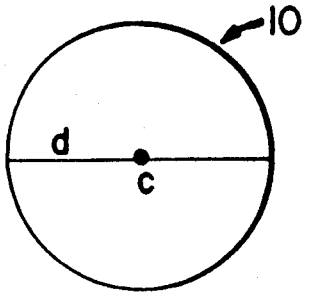
FIG. 2 (PRIOR ART)
FIG. 2 shows schematically, the cross-sectional shape of the conductor of FIG. 1.

Referring to FIGS. 1 and 2, an electrical conductor 10, used in accordance with the present invention is shown. Conductor 10 is a solid round copper wire of conventional construction used to transmit electrical signals therealong. Conductor 10 has a major longitudinal axis c and a circular cross-sectional shape as shown in FIG. 2.

Typical wire sizes used in accordance with the present invention include American Wire Gage (AWG) sizes 26 through 30. Round conductors of these sizes have diameters d of between 0.010 inches and 0.016 inches. The cross-sectional areas of these conductors range between approximately 100 and 250 circular mils. Electrical resistance of a copper wire is inversely proportional to its cross-sectional area. Therefore, larger wires will have less resistance and can accordingly carry a greater amount of electrical signal therealong.

Figure 3:
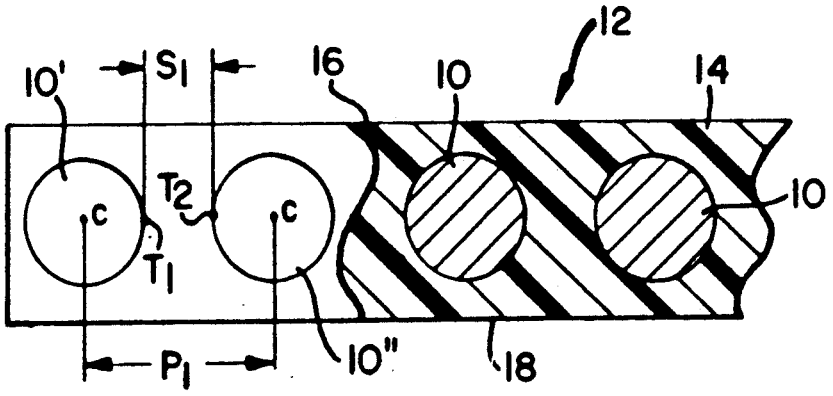
FIG. 3 (PRIOR ART)
FIG. 3 shows, partially in section and partially schematically, a portion of a conventional flat multiconductor cable including round conductors of the type shown in FIG. 1.

Referring now to FIG. 3, a plurality of conductors 10 are arranged in an electrical cable assembly 12. Cable assembly 12 includes an electrically insulative casing 14 formed of extruded plastic such as polyvinyl chloride (PVC). Casing 14 is generally flat having an upper planar surface 16 and a lower planar surface 18 substantially parallel thereto. While planar surfaces 16 and 18 are shown as flat, cable having undulating planar surfaces may also be employed. Cables of this type are commonly referred to as ribbon cables.

Conductors 10 are supported within casing 14 in electrical isolation. Conductors 10 are spaced from one another within casing 14 at a given pitch. Conductor pitch is defined by the distance between center line c of adjacent conductors 10. The pitch between conductors of flat ribbon cable is critical as ribbon cable is designed to be mass terminated to electrical connectors (not shown) having insulation displacing contacts fixedly supported in an insulative housing. The pitch of the cable must match the pitch of the connector. In FIG. 3, the conductors are spaced at a pitch of $P_1$. Since conductors 10 are of the round variety, the actual space between facing surfaces of adjacent conductors will be less than $P_1$.

As shown in FIG. 3, the distance between tangent points $T_1$ and $T_2$ of side-by-side conductors 10' and 10'' is $S_1$, which is substantially less than $P_1$. The impedance value of an electrical cable is determined, in part, by the spacial separation between facing surfaces of adjacent conductors. As the mass of insulating material increases between adjacent conductors, the impedance value of the cable will correspondingly increase. Thus, as conductor size is increased and/or the pitch between conductors is decreased, the impedance value of the cable will drop.

The present invention provides a technique for placing conductors at a closer pitch without either decreasing conductor size or decreasing the impedance value of the cable.

Figure 4:
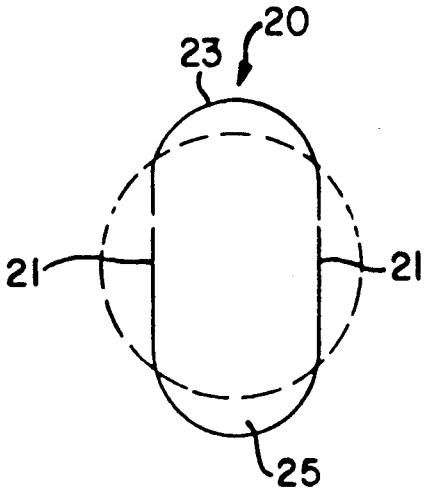
FIG. 4 shows schematically, an electrical conductor formed in accordance with the present invention.

Referring to FIG. 4, an electrical conductor formed in accordance with the present invention is shown. Conductor 20 is formed from a conventional solid round conductor such as conductor 10 shown in FIG. 1. The round conductor 20 is passed through flattening rollers (not shown) to form flat surfaces 21 along the length thereof. The rollers are of the type conventionally used in the metallic forming art to press flat surfaces on metallic objects. Rollers capable of such function are commercially available. Flat surfaces 21 may be placed on conductor 20 either simultaneously or by separate forming steps. As shown in FIG. 4, flat surfaces 21 are diametrically opposed and substantially parallel to one another.

An important feature of the present invention is that rather than cutting a flat surface on each diametrical side of conductor 20, the conductor is actually flattened in a manner such that opposed upper and lower rounded conductor surfaces 23 and 25 are outwardly deformed from their original condition. Thus, the cross-sectional area of conductor 20 does not change during formation. This permits the conductor to carry the same amount of signal current as was possible prior to the forming steps employed in the present invention.

Additionally, upper and lower surfaces 23, 25 also substantially maintain their rounded configuration. This facilitates the ability to mass terminate cable assembly 22 (FIG. 5) with conventional electrical connectors having insulation displacing contacts (not shown).

Figure 5:
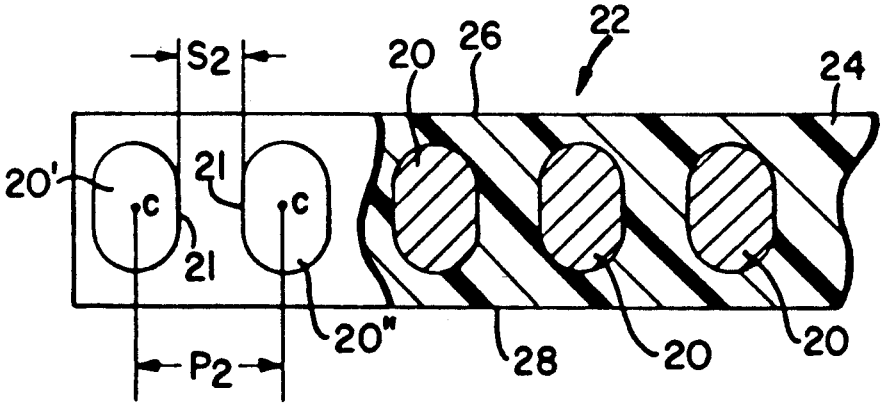
FIG. 5 shows, partially in section and partially schematically, a portion of an electrical cable of the present invention employing the conductor shown in FIG. 4.

Referring to FIG. 5, a cable assembly 22 of the present invention is shown. Cable assembly 22 includes insulative casing 24 similar to casing 14 shown in FIG. 3. Casing 24 includes upper and lower major planar surfaces 26 and 28 respectively which support therebetween conductors 20. Cable assembly 22 includes conductors 20 of the type shown in FIG. 4. Conductors 20 are arranged within casing 24 so that flattened surfaces 21 are substantially perpendicular to major planar surfaces 26 and 28 and center lines c lie in a common plane. Rounded surfaces 23 and 25 face major surfaces 26 and 28 respectively. Cable assembly 22 is typically formed by extruding insulative casing 24 over conductors 20.

The conductors 20 of cable assembly 22 are spaced at a pitch $P_2$ which is less than $P_1$ the pitch of cable assembly 12 (FIG. 3). Since each of conductors 20 includes flattened surfaces 21, the distance $S_2$ between facing flattened surfaces 21 of adjacent conductors 20' and 20'' is not correspondingly reduced. Comparing cable assembly 12 shown in FIG. 3, with cable assembly 22 of the present invention shown in FIG. 5, this feature is illustrated. While the conductor pitch of the cable assembly 22 of the present invention has been reduced from $P_1$ to $P_2$, the actual spacing between facing surfaces of adjacent conductors remains substantially the same. That is, $S_1 = S_2$.

As the amount of insulating mass between facing surfaces of adjacent conductors 20' and 20'' remains the same, the impedance value of cable assembly 22 would be substantially similar to impedance value of cable assembly 12. Also, as mentioned above, since conductors 20 maintain the same cross-sectional area as conductors 10, the signal carrying capability of cable assembly 22 is not reduced.

The present invention, as shown in FIG. 5, employs multiple conductors, each identically formed to have diametrically opposed flattened surfaces 21. However, it is contemplated that conductors 20 may be formed to have only one flattened surface. Also, it is contemplated that only selected ones of conductors 20 may be formed to have one or more flattened surfaces. This would permit the cable assembly 22 to have selected different impedance values as between various pairs of conductors.

Various changes to the foregoing described and shown structures would now be evident to those skilled in the art. Accordingly, the particularly disclosed scope of the invention is set forth in the following claims.

I claim:

1. An electrical cable assembly comprising:

a plurality of elongate electrical conductors; and an elongate electrically insulative casing continuously surrounding each of said conductors and supporting said conductors in side-by-side, electrically insulated, transversely spaced arrangement, said casing including a first major planar surface;

one of said conductors including a first flat surface portion facing an adjacent one of said conductors and a first curved surface portion facing said first major planar surface.

2. An electrical cable assembly of claim 1 wherein said casing includes a second major planar surface spaced from and substantially parallel to said first major planar surface and wherein said conductors are supported between said planar surfaces.

3. An electrical cable assembly of claim 2 wherein said one conductor includes a second flat surface portion spaced from and substantially parallel to said first flat surface portion.

4. An electrical cable assembly of claim 3 wherein said one conductor includes a second curved surface portion facing said second major planar surface.

5. An electrical cable assembly of claim 1 wherein said adjacent one of said conductors includes a flat surface portion facing said first flat surface portion of said one conductor.

6. An electrical cable assembly of claim 5 wherein said adjacent one of said conductors includes a curved surface portion facing said first major planar surface.

7. A flat multiconductor electrical cable comprising:

a substantially flat elongate insulative casing having upper and lower substantially parallel planar surfaces; and plural elongate electrical conductors arranged in transversely spaced disposition within said casing between said upper and lower planar surfaces, each of said conductors being individually electrically insulated by said casing;

each said conductor including a flat surface portion substantially perpendicular to said upper and lower planar surfaces and a curved surface portion facing one of said upper and lower planar surfaces.

8. A flat multiconductor electrical cable of claim 7 wherein each said conductor includes a pair of spaced substantially parallel flat surface portions, each flat surface portion being substantially perpendicular to said upper and lower planar surfaces.

9. A flat multiconductor electrical cable of claim 8 wherein each said conductor includes a pair of spaced oppositely facing curved surface portions.

10. A flat multiconductor electric cable of claim 9 wherein each of said oppositely facing curved surface positions faces a respective one of said upper and lower planar surfaces.

* * * * *